United States Patent [19]

Shin

[11] Patent Number: 5,032,326

[45] Date of Patent: Jul. 16, 1991

[54] FLASH-SPINNING OF POLYMERIC PLEXIFILAMENTS

[75] Inventor: Hyunkook Shin, Wilmington, Del.

[73] Assignee: E. I. du Pont de Nemours and Company, Wilmington, Del.

[21] Appl. No.: 378,176

[22] Filed: Jul. 14, 1989

Related U.S. Application Data

[63] Continuation-in-part of Ser. No. 238,698, Aug. 31, 1988.

[51] Int. Cl.[5] ..... D01D 5/11

[52] U.S. Cl. ..... 264/13; 264/205; 264/211; 264/211.14

[58] Field of Search ..... 264/205, 53, 13, 211, 264/140, 517, 518

[56] References Cited

U.S. PATENT DOCUMENTS

| | | | |
|---|---|---|---|
| 3,081,519 | 3/1963 | Blades et al. | 28/81 |
| 3,227,794 | 1/1966 | Anderson | 264/205 |
| 3,467,744 | 9/1969 | Woodell | 264/205 |
| 3,564,088 | 2/1971 | Woodell | 264/205 |
| 3,655,498 | 4/1972 | Woodell | 57/140 |
| 3,756,441 | 9/1973 | Anderson et al. | 264/205 |
| 3,879,519 | 4/1975 | Woodell | 264/53 |
| 4,554,207 | 11/1985 | Lee | 428/288 |

FOREIGN PATENT DOCUMENTS

| | | | |
|---|---|---|---|
| 62-33816 | 2/1987 | Japan . | |
| 62-104915 | 5/1987 | Japan | 264/205 |
| 62-243642 | 10/1987 | Japan . | |
| 62-250220 | 10/1987 | Japan . | |
| 891943 | 3/1962 | United Kingdom . | |
| 891945 | 3/1962 | United Kingdom . | |
| 1333059 | 10/1973 | United Kingdom | 264/205 |

OTHER PUBLICATIONS

P. S. Zurer, "Search Intensifies for Alternatives to Ozone-Depleting Hydrocarbons", Chemical & Engineering News, pp. 17-20 (Feb. 8, 1988).

Fluorocarbon/Ozone Update, "Alternatives to Fully Halogenated Chlorofluorocarbons", The du Pont Development Program, du Pont Bulletin E-90566 (Mar. 1987).

*Primary Examiner*—Hubert C. Lorin

[57] ABSTRACT

An improved process for flash-spinning plexifilamentary film-fibril strands is provided. A 5 to 30 and preferably 10 to 20 percent solution of polymer, preferably linear polyethylene, is formed in a spin fluid that consists essentially of 50 to 90 weight percent methylene chloride and 10 to 50 percent of a halocarbon, which preferably is chlorodifluoromethane, 1,1,1,2-tetrafluoroethane, 1,1-difluoroethane, 1,1,1,2-tetrafluoro-2-chloroethane or 1,1-difluoro-1-chloroethane. The solution is then flash-spun to form high quality plexifilamentary strands. The process avoids the use of halocarbon solvents that could be ozone-depletion hazards.

6 Claims, No Drawings

FLASH-SPINNING OF POLYMERIC PLEXIFILAMENTS

CROSS REFERENCE TO RELATED APPLICATION

This application is a continuation-in-part of application Ser. No. 07/238,698 Aug. 31, 1988.

BACKGROUND OF THE INVENTION

1. Field of the Invention

This invention relates to flash-spinning of polymeric plexifilamentary film-fibril strand. More particularly, the invention concerns an improved process in which the strand is flash-spun from mixtures of methylene chloride and a co-solvent.

2. Description of the Prior Art

Blades and White, U.S. Pat. No. 3,081,519, describes a flash-spinning process for producing plexifilamentary film-fibril strands from fiber-forming polymers. A solution of the polymer in a liquid, which is a non-solvent for the polymer at or below its normal boiling point, is extruded at a temperature above the normal boiling point of the liquid and at autogenous or higher pressure into a medium of lower temperature and substantially lower pressure. This flash spinning causes the liquid to vaporize and thereby cool the plexifilamentary film-fibril strand that forms from the polymer. Preferred polymers include crystalline polyhydrocarbons such as polyethylene and polypropylene.

According to U.S. Pat. No. 3,081,519 the following liquids are useful in the flash-spinning process: aromatic hydrocarbons such as benzene, toluene, etc.; aliphatic hydrocarbons such as butane, pentane, hexane, heptane, octane, and their isomers and homologs; alicyclic hydrocarbons such as cyclohexane; unsaturated hydrocarbons; halogenated hydrocarbons such as methylene chloride, carbon tetrachloride, chloroform, ethyl chloride, methyl chloride; alcohols; esters; ethers; ketones; nitriles; amides; fluorocarbons; sulfur dioxide; carbon disulfide; nitromethane; water; and mixtures of the above liquids. The patent further states that the flash-spinning solution additionally may contain a dissolved gas, such as nitrogen, carbon dioxide, helium, hydrogen, methane, propane, butane, ethylene, propylene, butane, etc. Preferred for improving plexifilament fibrillation are the less soluble gases, i.e., those that dissolve to a less than 7% concentration in the polymer solution under the spinning conditions.

Many examples of U.S. Pat. No. 3,018,519 and British Patents 891,943 and 891,945 describe flash-spinning of polyethylene from methylene chloride or from methylene chloride with a co-solvent. However, the resultant products are generally unsatisfactory for producing plexifilamentary film-fibril strands of the quality required for commercial production of spunbonded sheet products. Commercial spunbonded products made from polyethylene plexifilamentary film-fibril strands have been successfully produced with the polyethylene being flash-spun from trichlorofluoromethane (Freon-11). Although Freon-11 has been used extensively for this purpose, the escape of such a halocarbon into the atmosphere has been implicated as a serious source of depletion of the earth's ozone. A general discussion of the ozone-depletion problem is presented, for example, by P. S. Zurer, "Search Intensifies for Alternatives to Ozone-Depleting Halocarbons", *Chemical & Engineering News*, pages 17–20 (Feb. 8, 1988). The substitution of methylene chloride for trichlorofluoromethane in the commercial flash-spinning process should avoid the ozone depletion problem, but plexifilamentary film-fibril strands of polyethylene which are flash-spun from methylene chloride, with or without co-solvent, as exemplified in the referred-to patents, are inadequate; they do not meet the high fibrillation quality of the strands produced by the commercial process which employs trichlorofluoromethane as the spin solvent.

An object of this invention is to provide an improved process for flash-spinning polyethylene plexifilamentary film-fibril strand of high quality from a fluid that should not present ozone-depletion hazards,

SUMMARY OF THE INVENTION

The present invention provides an improved process for flash-spinning plexifilamentary film-fibril strands of synthetic fiber-forming polymer, particularly linear polyethylene. The process is of the type wherein the polymer is mixed with a spin fluid consisting essentially of methylene chloride and a co-solvent to form a spin mixture containing 5 to 30 and preferably 10 to 25 weight percent of polymer, and the mixture is then flash-spun at a pressure that is greater than the autogenous pressure of the spin fluid into a region of substantially lower temperature and pressure. The improvement comprises, in combination, the co-solvent being a halocarbon of 1, 2 or 3 carbon atoms and at least one hydrogen atom, having a boiling point in the range of 0° to −50° C. and amounting to 10 to 50 percent, preferably 10 to 35 percent, by weight of the spin fluid and the mixing and the flash-spinning being performed at a temperature in the range of 130° to 240° C., preferably 140° to 220° C., and a pressure in the range of 500 ($3.5\times10^6$ Pa) to 5000 psi ($3.5\times10^7$ Pa) often 1,000 ($6.9\times10^6$ Pa) to 5,000 psi ($3.5\times10^7$ Pa), and more preferably 800 ($5.5\times10^6$ Pa) to 2,500 psi ($1.7\times10^7$ Pa).

Preferred halocarbons for use as co-solvent include
chlorodifluoromethane ("HC-22"),
1,1,2-tetrafluoroethane ("HC-134a"),
1,1-difluoroethane ("HC-152a"),
1,1,1,2-tetrafluoro-2-chloroethane ("HC-124")
and 1,1-difluoro-1-chloroethane ("HC-142b").

The present invention also includes novel solutions which comprise 5 to 30 weight percent of synthetic fiber-forming polymer, preferably, linear polyethylene, or polypropylene, most preferably linear high density polyethylene, in a fluid consisting essentially of 50 to 90 weight percent methylene chloride and 10 to 50 weight percent of a halocarbon in accordance with the requirements listed above.

DETAILED DESCRIPTION OF PREFERRED EMBODIMENTS

The term "synthetic fiber-forming polymers" is intended to encompass the same classes of polymers disclosed in the flash-spinning art described above. The term "polyethylene", the preferred polymer for use in the invention, as used herein, is intended to embrace not only homopolymers of ethylene, but also copolymers wherein at least 85% of the recurring units are ethylene units. The preferred polyethylene is a homopolymeric linear polyethylene which has an upper limit of melting range of about 130° to 135° C., a density in the range of 0.94 to 0.98 g/cm$^3$ and a melt index (as defined by ASTM D-1238-57T, Condition E) of 0.1 to 6.0.

The term "plexifilamentary film-fibril strands of polyethylene", as used herein, means a strand which is characterized as a three-dimensional integral network of a multitude of thin, ribbon-like, film-fibril elements of random length and of less than about 4 microns average thickness, generally coextensively aligned with the longitudinal axis of the strand. The film-fibril elements intermittently unite and separate at irregular intervals in various places throughout the length, width and thickness of the strand to form the three-dimensional network. Such strands are described in further detail by Blades and White, U.S. Pat. No. 3,081,519 and by Anderson and Romano, U.S. Pat. No. 3,227,794.

The present invention provides an improvement in the known process for producing polyethylene plexifilamentary strands by flash-spinning a spin mixture of linear polyethylene in methylene chloride. In the known processes, which are described in the above-mentioned United States and British patents, linear polyethylene is dissolved in a spin liquid that includes methylene chloride and a co-solvent to form a spin solution contains 10 to 20 weight percent linear polyethylene, which solution is then flash-spun at a pressure that is greater than the autogenous pressure of the spin liquid into a region of substantially lower temperature and pressure.

The key improvement of the present invention requires the co-solvent to be a halocarbon of 1, 2 or 3 carbon atoms and at least one hydrogen atom, having a boiling point in the range of 0° to −50° C. Such incompletely halogenated halocarbons, if released to the atmosphere, are considered to present a minimal ozone-depletion hazard. These halocarbons are believed to decompose before they can cause damage to the ozone. Preferred halocarbons for use in the invention include:

chlorodifluoromethane ("HC-22"),
1,1,1,2-tetrafluoroethane ("HC-134a"),
1,1-difluoroethane ("HC-152a"),
1,1,1,2-tetrafluoro-2-chloroethane ("HC-124").
1,1-difluoro-1-chloroethane ("HC-142b")

The parenthetic designation is used herein as an abbreviation for the chemical formula of the halocarbon. The boiling points of these halocarbons are as follows:

HC-22. −40.8° C.
HC-134a. −26.5° C.
HC-152a. −24.7° C.
HC-124. −12 ° C.
HC-142b. −9.2° C.

The halocarbons suited for use as co-solvent in the present invention represent a very small, narrow selection from all materials, let alone halocarbons, that could have been considered for possible use as co-solvents.

According to the present invention, the halocarbon amounts to 10 to 50 percent, preferably 10 to 35 percent, of the total weight of the spin fluid. The remainder of the spin fluid is essentially methylene chloride. The mixing and the flash-spinning is usually performed at about the same temperature, which temperatures are in the range of 130° to 240° C., preferably 140° to 220° C. The pressure of mixing and spinning can be the same, but often the pressure is reduced somewhat after solution preparation and immediately before flash-spinning. Nonetheless, both the mixing and the flash-spinning pressures are in the range of 500 ($3.4\times10^6$ Pa) to 5,000 psi ($3.4\times10^7$ Pa), and most preferably 800, to 2,500 psi ($5.5\times10^6$ to $1.7\times10^7$ Pa). The spin liquid consists essentially of methylene chloride and the halocarbon co-solvent. However, conventional flash-spinning additives can be incorporated into the spin mixtures by known techniques. These additives can function as ultraviolet-light stabilizers, antioxidants, fillers, dyes, and the like.

The quality of the plexifilamentary film-fibril strands produced in the Examples below was rated subjectively. A rating of "5" indicated that the strand was a better fibrillation quality than is usually achieved in the commercial production of spunbonded sheet made from such flash-spun polyethylene strands. A rating of "4" indicated that the product was about as good as commercially flash-spun strands. A rating of "3" indicated that the strands were not as good as the commercially flash-spun strands and are considered to be inadequate for the purposes of the present invention. A "2" indicated a very poorly fibrillated, inadequate strand. A "1" indicated no strand formation. Commercial strand product is produced from solutions of about 12.5% linear polyethylene in Freon ®-11, substantially as set forth in Lee, U.S. Pat. 4,554,207, column 4, line 63, through column 5, line 10, which disclosure is hereby incorporated herein by reference.

The invention is illustrated in the Examples which follow with linear polyethylene as the polymer and the preferred halocarbons as the co-solvent. Batch processes in equipment of relatively small size are employed. Such batch processes can be scaled-up and converted to continuous flash-spinning processes that can be performed, for example, in the type of equipment disclosed by Anderson and Romano, U.S. Pat. No. 3,227,794. For each of the Examples and comparisons, a high density linear polyethylene of 0.76 Melt Index was employed, except Example 22 for which polypropylene of 0.4 Melt Flow Rate was employed.

The Examples are intended to illustrate the present invention and are not intended to limit its scope, which is defined by the claims. In the Examples and Tables, processes of the invention are identified with Arabic numerals. The processes identified as "A", "B", "C", "D", "E" and "F" are comparisons that are outside the invention.

EXAMPLES 1-5 AND COMPARATIVE EXAMPLE A

These examples illustrate flash-spinning of high quality plexifilamentary film-fibril strands of polyethylene in accordance with the process of the invention. In these examples, methylene chloride and a halocarbon co-solvent selected in accordance with the invention are employed as the spin fluid. The advantage in producing plexifilaments of high quality fibrillation is demonstrated for spin liquids of the invention (Examples 1-5) by comparing the resultant strands with those obtained when using a spin liquid which is 100% methylene chloride (Comparison A).

The plexifilamentary strands for these examples and for Comparison A were each prepared in equipment of the same design, but which may have differed only in capacity. One apparatus, designated "I" had a capacity of 1 gallon ($3.785\times10^{-3}m^3$); the apparatus, designated "II" had a capacity of 50 $cm^3$. Apparatus I was used for Examples 1 and 2 and Comparison A. Apparatus II was used for Examples 3, 4 and 5.

Each apparatus comprised a pair of high pressure cylindrical vessels, each fitted at one end with a piston for applying pressure to the contents of the vessel. The other ends of each of the vessels were interconnected by a transfer line. The transfer line contained a series of fine mesh screens intended for mixing the contents of the apparatus by forcing the contents through the transfer line from one cylinder to the other. A spinneret assembly having an orifice of 0.030-inch ($7.6\times10^{-4}$) diameter was connected to the transfer line with quick acting means for opening and closing the orifice. Means were included for measuring the pressure and temperature inside the vessel.

For these examples, the apparatus was loaded with the desired amounts of polyethylene and spin fluid and a pressure of 1,800 psi (12410 kPa) was applied. The quantities of ingredients were selected to form a spin solution containing about 12 weight percent of linear polyethylene and about 88 weight percent of spin fluid. Heating was then begun. When Apparatus I was used, the contents of the apparatus were heated to 180° C. and then heated further to 210° C. During the further heating, which continued for about an hour and a half, a differential pressure of about 50 psi (345 kPa) was alternately established between the two cylinders to repeatedly force the contents through the transfer line from one cylinder to the other to provide mixing and effect formation of a solution. When Apparatus II was used, the temperature was 140° C. at the start of the mixing. With the pressure at 1800 psig (1240 kPa) and the temperature at 210° C. (or 200° C. for Comparison A), the line to the spinneret orifice was opened quickly. The resultant flash-spun product was then collected. The results of the tests are summarized in the following table.

TABLE I

| | Example No. | | |
|---|---|---|---|
| | 1 | 2 | 3 |
| Polyethylene wt % | 12 | 12.2 | 12 |
| Co-solvent | HC-22 | HC-134a | HC-142b |
| Spin fluid wt % | | | |
| $CH_2Cl_2$ | 85.0 | 86.0 | 85.0 |
| Co-solvent | 15.0 | 14.0 | 15.0 |
| Strand Quality | 5 | 4 | 4 |
| | Example No. | | |
| | 4 | 5 | A |
| Polyethylene wt % | 11.4 | 11.9 | 12 |
| Co-solvent | HC-124 | HC-152a | None |
| Spin fluid wt % | | | |
| $CH_2Cl_2$ | 67.0 | 85.0 | 100.0 |
| Co-solvent | 33.0 | 15.0 | 0 |
| Strand Quality | 4 | 4 | 3 |

EXAMPLES 6 TO 22 AND COMPARATIVE EXAMPLES B TO F

For Examples 6 to 21 and B to F in Table II, high density linear polyethylene of 0.76 Melt Index was employed. The apparatus used consists of two high pressure cylindrical chambers, each equipped with a piston which is adapted to apply pressure to the contents of the vessel. The cylinders have an inside diameter of 1.0 inch ($2.54\times10$-2 m) and each has an internal capacity of 50 cubic centimeters. The cylinders are connected to each other at one end through a 3/32 inch ($2.3\times10$-3 m) diameter channel and a mixing chamber containing a series of fine mesh screens used as a static mixer. Mixing is accomplished by forcing the contents of the vessel back and forth between the two cylinders through the static mixer. A spinneret assembly with a quick-acting means for opening the orifice are then attached to the channel through a tee. The spinneret assembly consists of a pressure letdown orifice of 0.03375 inch ($8.5\times10$-4 m) diameter and 0.030 inch length ($7.62\times10$-4 m), a letdown chamber of 0.25 inch ($6.3\times10^{-3}$m) diameter and 1.92 inch length, and a spinneret orifice of 0.030 inch ($7.62\times10$-4 m) diameter. The pistons are driven by high pressure water supplied by a hydraulic system. Pressure transducers are used to measure the pressure before and after the letdown orifice.

In operation, the apparatus is charged with polyethylene pellets, methylene chloride and the co-solvent to be employed, and high pressure water, e.g. 1800 psi (12410 kPa) is introduced to drive the piston to compress the charge. The contents then are heated to 140° C. and held at that temperature for about an hour or longer during which time a differential pressure of about 50 psi (345 kPa) is alternatively established between the two cylinders to repeatedly force the contents through the mixing channel from one cylinder to the other to provide mixing and effect formation of a solution. The solution temperature is then raised to the final spin temperature, and held there for about 15 minutes to equilibrate the temperature. Mixing is continued throughout this period. Finally, the spinneret orifice is opened, and the resultant flash-spun product is collected. The pressure inside the letdown chamber recorded during spinning using a computer is entered as spin pressure in Table II. For Example 20, the letdown chamber was not used, and the pressure measured just before the spinneret during spinning was entered as the spin pressure.

In Table II mix T stands for mixing temperature, Mix P stands for mixing pressure, T(GPD) stands for Tenacity in grams per denier as measured at 1 inch ($2.54\times10$-2 m) gauge length 10 turns per inch ($2.54\times10$-2 m) and SA ($M^2$/GM) stands for surface area in square meters per gram. NM means not measured. In Table II the percent solvent reported is weight percent solvent based on total amount of solvent present.

Example 22 shows that well fibrillated plexifilaments can be obtained from other types of polyolefins using this invention. The apparatus and methodology used in this example were the same as the examples in Table II except polyethylene was substituted with isotactic polypropolylene with a Melt Flow Rate of 0.4, available commercially under the tradename "Profax 6823" by Hercules, Inc. Wilmington, Del. In addition, higher mixing temperature was used to compensate for the higher melting point of the polymer. The conditions used and the properties of the resultant fiber are summarized in Table II. The polymer mix contained 2.6 wt % based on polymer of Inganox ® 1010 as an antioxidant.

TABLE II

| | Example No. | | | | | |
|---|---|---|---|---|---|---|
| | 6 | 7 | 8 | 9 | 10 | 11 |
| Polymer Conc WGT % | 12 | 25 | 12 | 20 | 25 | 12 |
| Solvent | $CH_2Cl_2$ | $CH_2Cl_2$ | $CH_2Cl_2$ | $CH_2Cl_2$ | $CH_2Cl_2$ | $CH_2Cl_2$ |
| Co-Solvent | HCFC-124 (25 WGT %) | HCFC-124 (25 WGT %) | HCFC-142B (33.3 WGT %) | HCFC-142B (25 WGT %) | HCFC-142B (25 WGT %) | HCFC-22 (25 WGT %) |
| Mix T °C. | 140 | 140 | 140 | 140 | 140 | 140 |
| Mix P Psi | 1800 | 1800 | 1800 | 1800 | 1800 | 1800 |

TABLE II-continued

| | | | | | | |
|---|---|---|---|---|---|---|
| (kPa) | (12410) | (12410) | (12410) | (12410) | (12410) | (12410) |
| Spin T °C. | 200 | 180 | 180 | 180 | 180 | 200 |
| Spin P Psi | ~1240 | ~1350 | ~1310 | ~1260 | ~590 | ~1425 |
| (kPa) | (8550) | (9308) | (9030) | (8687) | (4068) | (9825) |
| Denier | 196.5 | 537 | 324 | 422.4 | 722 | 200 |
| T (GPD) | 2.21 | 2.44 | 2.626 | 2.55 | 1.842 | 3.55 |
| Strand Quality | 4.5 | 4.5 | 4 | 4 | 4 | 4 |
| SA ($M^2$/GM) | nm | 38.9 | 20 | nm | 25.6 | 31.7 |

| | Example No. | | | | | |
|---|---|---|---|---|---|---|
| | 12 | 13 | 14 | 15 | 16 | 17 |
| Polymer Conc WGT % | 20 | 25 | 25 | 25 | 7 | 20 |
| Solvent | $CH_2Cl_2$ | $CH_2Cl_2$ | $CH_2Cl_2$ | $CH_2Cl_2$ | $CH_2Cl_2$ | $CH_2Cl_2$ |
| Co-Solvent | HCFC-22 | HCFC-22 | HCFC-22 | HCFC-22 | HCFC-22 | HCFC-22 |
| | (31.5 WGT %) | (33.3 WGT %) | (33.3 WGT %) | (40 WGT %) | (15 WGT %) | (40 WGT %) |
| Mix T °C. | 140 | 140 | 140 | 140 | 140 | 140 |
| Mix P Psi | 1800 | 1800 | 1800 | 1800 | 1800 | 5000 |
| (kPa) | (12410) | (12410) | (12410) | (12410) | (12410) | (34470) |
| Spin T °C. | 180 | 180 | 200 | 180 | 220 | 180 |
| Spin P Psi | ~1450 | ~1400 | ~1440 | ~1350 | ~1300 | ~2670 |
| (kPa) | (9997) | (9653) | (9928) | (9308) | (8963) | (18410) |
| Denier | 408 | 453 | 409 | 604 | 136.2 | 751 |
| T (GPD) | 1.71 | 2.05 | 2.99 | 2.09 | 1.05 | 2.08 |
| Strand Quality | 5 | 4.5 | 4 | 4.5 | 4 | 4 |
| SA ($M^2$/GM) | 48.4 | 55 | 23.8 | 27.3 | nm | nm |

| | Example No. | | | | |
|---|---|---|---|---|---|
| | 18 | 19 | 20 | 21 | 22 |
| Polymer Conc WGT % | 12 | 25 | 25 | 25 | 20 |
| Solvent | $CH_2Cl_2$ | $CH_2Cl_2$ | $CH_2Cl_2$ | $CH_2Cl_2$ | $CH_2Cl_2$ |
| Co-Solvent | HFC-134A | HFC-134A | HCFC-134A | HFC-152A | HCFC-22 |
| | (15 WGT %) | (16.7 WGT %) | (25 WGT %) | (15 WGT %) | (33.3 WGT %) |
| Mix T °C. | 140 | 140 | 140 | 140 | 180 |
| Mix P Psi | 1800 | 1800 | 1800 | 1800 | 1800 |
| (kPa) | (12410) | (12410) | (12410) | (12410) | (12410) |
| Spin T °C. | 200 | 180 | 180 | 180 | 200 |
| Spin P Psi | ~1450 | ~1160 | nm | ~1060 | ~1500 |
| (kPa) | (9997) | (7998) | | (7308) | (10342) |
| Denier | 387.5 | 368 | 692 | 441 | 273.5 |
| T (GPD) | 2.27 | 2.5 | 1.863 | 1.92 | 1.31 |
| Strand Quality | 4 | 4.5 | 4.5 | 4.5 | 4 |
| SA ($M^2$/GM) | nm | 37.9 | 29.7 | nm | |

| | Example No. | | | | |
|---|---|---|---|---|---|
| | COMPARISON B | COMPARISON C | COMPARISON D | COMPARISON E | COMPARISON F |
| Polymer Conc WGT % | 12 | 12 | 25 | 25 | 12 |
| Solvent | $CH_2Cl_2$ | $CH_2Cl_2$ | $CH_2Cl_2$ | $CH_2Cl_2$ | FREON 11 |
| Co-Solvent | NONE | NONE | NONE | NONE | NONE |
| Mix T °C. | 140 | 140 | 140 | 140 | 180 |
| Mix P Psi | 1800 | 1800 | 1800 | 1800 | 1500 |
| (kPa) | (12410) | (12410) | (12410) | (12410) | (10342) |
| Spin T °C. | 180 | 210 | 180 | 210 | 180 |
| Spin P Psi | ~1075 | ~1160 | ~880 | ~710 | ~1080 |
| (kPa) | (7412) | (7998) | (6067) | (4895) | (7446) |
| Denier | 588 | 304.5 | 1148 | 645.2 | 335 |
| T (GPD) | 0.542 | 2.04 | 0.561 | 1.481 | 2.32 |
| Strand Quality | 2 | 3.5 | 2 | 3 | 4.5 |
| SA ($M^2$/GM) | 3.57 | 18.84 | 5.28 | 50.9 | 32.3 |

I claim:

1. An improved process for flash-spinning plexifilamentary film-fibril strands of synthetic fiber-forming polymer wherein the polymer is mixed with a spin fluid consisting essentially of methylene chloride and a co-solvent to form a spin mixture containing 5 to 30 weight percent of polymer which mixture is then flash-spun at a pressure that is greater than the autogenous pressure of the spin fluid into a region of substantially lower temperature and pressure, the improvement comprising, in combination, the co-solvent being a halocarbon of 1, 2 or 3 carbon atoms and at least one hydrogen atom, having a boiling point in the range of 0° to −50° C. and amounting to 10 to 50 percent by weight of the spin fluid and the mixing and the flash-spinning being performed at a temperature in the range of 130° to 240° C. and a pressure in the range of 500 to 5,000 psia.

2. The process of claim 1 wherein the halocarbon is selected from the group consisting of chlorodifluoromethane, 1,1,1,2-tetrafluoroethane, 1,1-difluoroethane, 1,1,1,2-tetrafluoro-2-chloroethane and 1,1-difluoro-1-chloroethane.

3. The process of claim 2 wherein the polymer is linear polyethylene.

4. The process of claim 2 wherein the polymer is isotactic polypropylene.

5. The process of claim 3 wherein the halocarbon amount to 10 to 35 percent by weight of the spin fluid and the mixing and the flash-spinning are performed at a temperature in the range of 140° to 220° C. and a pressure in the range of 800 to 2,500 psia.

6. The process of claim 4 wherein the halocarbon amounts to 10 to 35 percent by weight of the spin fluid and the mixing and the flash spinning are performed at a temperature in the range of 140° to 220° C. and a pressure in the range of 800 to 2,500 psia.

* * * * *